US005957583A

United States Patent [19]

DeClements, Jr. et al.

[11] Patent Number: 5,957,583

[45] Date of Patent: Sep. 28, 1999

[54] PORTABLE MULTI PURPOSE SELECTIVELY INFLATABLE CONTAINER

[75] Inventors: Russell W. DeClements, Jr., 719 Cherrie Ave., Sherwood, Ark. 72120; Russell W. DeClements, Sr., Marathon; Allen C. McReynolds, Ram Rod Key, both of Fla.

[73] Assignee: Russell W. DeClements, Jr., Sherwood, Ark.

[21] Appl. No.: 09/087,878

[22] Filed: Jun. 1, 1998

[51] Int. Cl.[6] ..... B65D 30/00

[52] U.S. Cl. ..... 383/3; 383/10

[58] Field of Search ..... 383/3, 10

[56] References Cited

U.S. PATENT DOCUMENTS

| | | | |
|---|---|---|---|
| 1,864,648 | 6/1932 | Haines | 383/3 X |
| 1,950,571 | 3/1934 | Rubin | 383/3 X |
| 3,204,678 | 9/1965 | Worcester | 383/3 |
| 5,316,386 | 5/1994 | Moore | 383/10 |
| 5,348,155 | 9/1994 | Ishiwa | 383/3 X |
| 5,454,642 | 10/1995 | De Luca | 383/3 |

FOREIGN PATENT DOCUMENTS

| | | | |
|---|---|---|---|
| 704493 | 2/1954 | United Kingdom | 383/3 |

*Primary Examiner*—Jes F. Pascua
*Attorney, Agent, or Firm*—Dennis B. Haase

[57] ABSTRACT

The present invention comprises a portable container in the nature of a tote bag in which an inner wall is affixed to one of the primary walls so as to form an air tight bladder, or chamber, which is selectively inflatable and deflatable to enhance the utility of the bag and, further, having integrally formed and aligned cut outs in the opposed facing primary walls to permit facile gripping and transporting the bag and its contents.

14 Claims, 1 Drawing Sheet

PORTABLE MULTI PURPOSE SELECTIVELY INFLATABLE CONTAINER

The present invention relates generally to portable containers, in the nature of tote bags, but more particularly to such a container wherein a portion thereof is selectively inflatable for a number of alternative uses.

BACKGROUND OF THE INVENTION

1. Field of the Invention

Since the memory of man runneth not to the contrary, the distaff side of the population has carried their personal belongings in a bag or purse. When shopping is part of the agenda, the size of the receptacle grows in proportion to the goal of the trip.

While the retailer often provides a means of carrying away the purchase, it is increasingly common for the shopper to carry his or her own tote bag, particularly if there is more than one destination on the itinerary.

Shopping is not the only activity that calls for a tote bag or the like, and when the destination includes the beach or lake, for example, or some other recreational activity, e.g., a picnic or a ball game, or perhaps fishing or hiking, the venerable tote bag becomes a valuable accessory.

The focus of the present invention, as will become abundantly clear, is to materially increase the value of the tote type bag to the user without increasing its complexity in manufacture or use, and, in particular, without greatly increasing the cost to the consumer beyond its perceived value.

2. Overview of the Prior Art

While tote bags generally have been the subject of some development, the focus has typically been on expanding the number of pockets within the confines of the bag itself. Some have added snaps and others zippers; some pockets are big and others little, and some assume a shape for a particular purpose, such as to hold a calculator, or even a portable CD player.

Some tote bags are highly specialized, and among them is the bag disclosed in Worchester Patent 3,204,678. Worchester has constructed a beach bag, to carry accessories on an excursion to the water. The essence of Worchester is a centrally disposed envelope having a series of internal pockets that are inflatable. Worchester elects to place the inflatable portion of his bag in the center in order to serve as a vapor barrier of sorts between wet clothes and dry clothes.

The problem, of course, is that when inflated, by virtue of the single bottom seam 3, both sections on either side of the inflated section are literally choked off so that neither can hold anything, unless, of course, the bag is completely redesigned, in which case, to serve its intended purpose, it would necessarily be so large that it becomes cumbersome to handle and unpleasant to lug along on any excursion.

Jordan Patent 4,146,970 is another example of an inflatable bag. It differs from Worchester in that the inflatable cells of Jordan are disposed about the periphery of the container itself. Jordan employs the inflated cells as a means of insulation, although the disclosure does not say for what.

Yet another inflatable envelope is disclosed in the Koves Design Patent Des. 273,166, which appears to be nothing more than a single purpose inflatable seat cushion.

A similar concept appears in the patent of Fallis, 4,708,393, with the twist that when deflated the seat cushion fits in its own little pocket 26, which is formed integrally with it. Neither Koves nor Fallis are even remotely concerned about versatility. Rather, they provide a soft place to sit.

In addition to the foregoing, Breedlove Patent 5,191,665, discloses a somewhat different wrinkle to the comfort of an inflatable cushion. In Breedlove, a heating unit is provided for so as to permit seating in comfort in cold weather.

Finally, as an exclamation mark to the inflatable seat industry, Howard Patent 3,253,861 discloses an inflatable seat and back rest in combination.

For the most part, all of the various prior art devices are unitary in purpose and lack either the versatility or utility of the present invention, or both. What the art does point out is that there is a need for the present invention and that prior efforts at filling that need have, thus far, fallen short.

SUMMARY OF THE INVENTION

The device of the present invention, whether referred to as a bag, container or receptacle, provides the user with a unique combination of uses which makes it not only versatile, but utilitarian.

It was and is an objective of the present invention to provide the consumer with a multi purpose tote bag which is not only capable of carrying a variety of items, wet or dry, larger or smaller, and in a variety of shapes, and to, coincidently, when inflated, simultaneously serve as a cushion when desired, and even a flotation device when needed.

It is another objective, ancillary to the forgoing, to provide a highly versatile tote type bag which is available to the consuming public at an entirely affordable price, which objective is readily accomplished by means of a simplified construction which results in a strong, durable product.

It will become apparent from a reading of the detailed description that the bag of the present invention not only accomplishes all of the foregoing goals and objectives, but further and additional objectives, and has other uses and benefits not specifically underscored herein, particularly when the description is read in conjunction with the accompanying drawing, wherein:

IN THE DRAWINGS

DETAILED DESCRIPTION OF A PREFERRED EMBODIMENT

Figure 1:
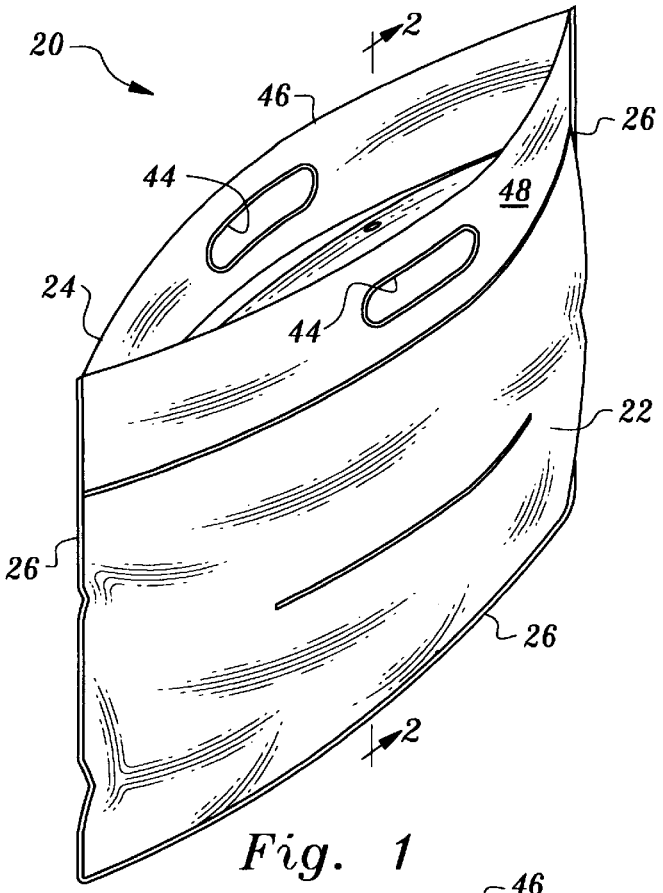
FIG. 1, is a pictorial representation of a container constructed in accordance with the present invention, illustrated in an opened condition.

With reference now to the drawings, and initially to FIG. 1, a novel tote bag 20, constructed in accordance with the present invention, is illustrated in some detail.

The tote bag 20 is formed by the union of a pair of primary side wall members 22 and 24, which, for purposes of defining the tote bag 20, are substantially the same size and configuration. While the illustrated tote bag is rectangular in configuration, it will be appreciated that virtually any geometric, or even non geometric, configuration would be possible without departure from the invention. Practical considerations and common sense are perhaps the only constraints on the shape of the tote bag.

Figure 2:
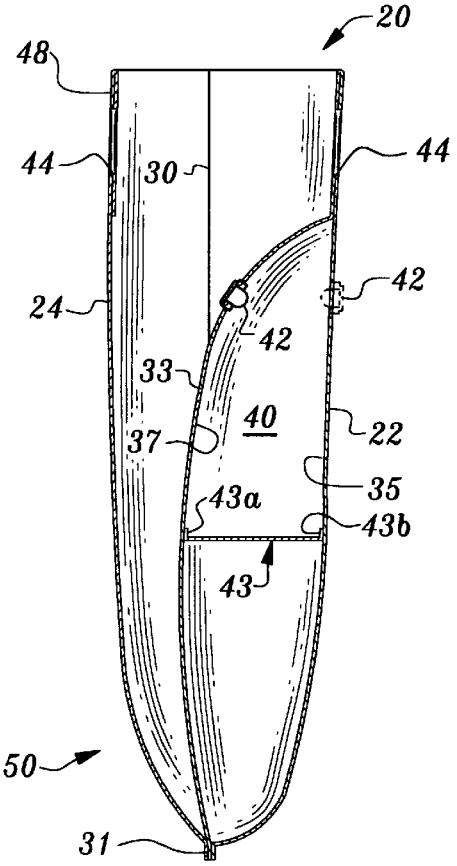
FIG. 2, is a side elevation of the container of FIG. 1, sectioned to illustrate certain details of construction and, further, showing the container in an inflated condition.
Figure 3:
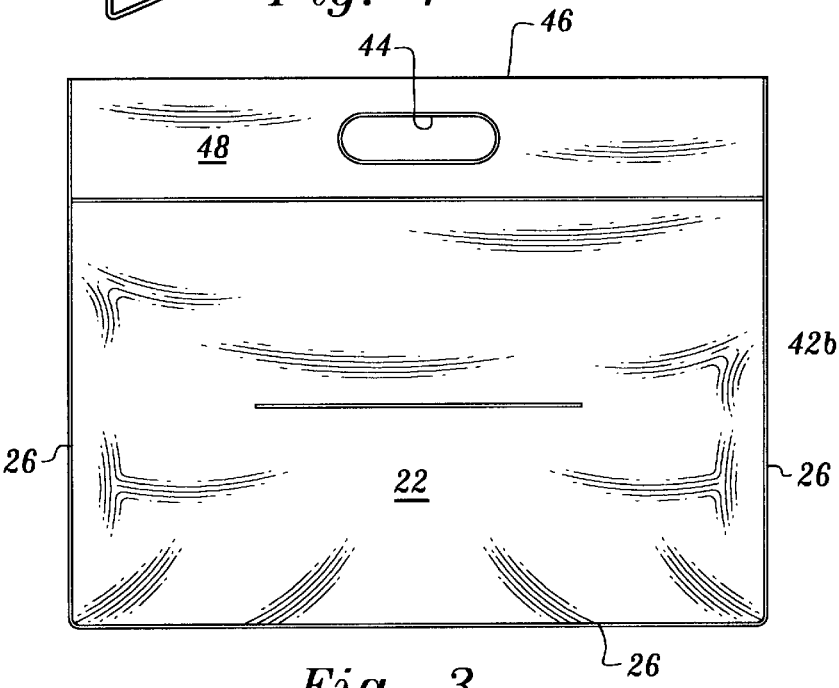
FIG. 3, is a side elevation of the container of FIG. 1.
Figure 4:
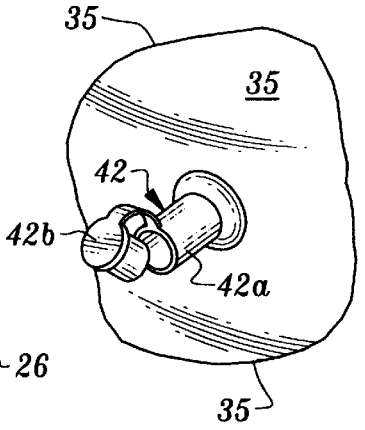
FIG. 4, is a detail view of the inflation and deflation valve.

Each of the primary side wall members 22 and 24 are formed, or otherwise provided, with joinable edges 26 which are, as best seen in FIG. 2 at the edges or termini of the side walls 22 and 24. It is contemplated that, as a practical necessity, the tote bag 20 will be constructed of a plastic material that can be fused, such as by heat welding, to form the bag. Again, however, it will be clearly understood that other materials, like other shapes, may be employed without departure from the invention, even though they may not be as practical or cost effective.

In accordance with the invention, opposed face to face primary side walls 22 and 24 are welded, or otherwise connected along their respective joinable edges 26 to create side seams 30, and a base seam 31. Once matched and sealed at the seams 30 and 31, the basic bag is thus formed and is capable of carrying a variety of objects within its confines.

The present invention, however, contemplates the creation of a multi function receptacle or bag. Thus, and in keeping with the further facets of the invention, an inner wall 33 is provided. The precise size and configuration of the inner wall 33 is a matter of drawing a balance between practical considerations and personal preference based on intended usage. Realistically, the inner wall 33 is dimensionally equal to, or smaller than, the primary side walls 22 and 24. Indeed, the inner wall may be integrally formed with the primary side wall if such an arrangement appears to be most economical, or a separate panel, each without departure from the essential aspects of the invention.

In keeping with that aspect of the invention which calls for the creation of an inflatable bladder, the inner wall 33 is welded, or otherwise affixed along the edges 35 of the inner wall to one of the primary side walls, along the inner surface 37 thereof, such that, once in place against the inner face 35, of primary sidewall 22, for example, the inner surface 37 of the sidewall 22 and the inner wall together define a bladder or chamber 40.

The seal between the edges of the inner wall and the inner surface 37 of the side wall 22 is to be airtight, irrespective of how it is formed. It will be appreciated that several methods of sealing, including but not limited to heat sealing or gluing, all familiar to those skilled in the art, are within the contemplation of the invention. Thus, the bladder 40 is capable of receiving and holding air under low pressure.

In order to permit selective introduction and exhaustion of air in the bladder 40, a valve 42 is provided. The valve contemplated is well known and includes a cylindrical stem 42*a* for oral induction of air in the bladder by simply blowing into the stem. A cap 42*b* is sealingly insertable into the stem 42*a* to secure the airtight integrity of the chamber 40. The stem 42*a* is then tucked into a pocket, not illustrated with specificity, in the valve to avoid inadvertent exhaustion of the air so introduced. Once again, other valve mechanisms, well known in the art, may be substituted for that described without departure from this aspect of the invention.

In keeping with yet another aspect of the invention, the nature of the materials preferred for construction of the bag 20 are such that stretching thereof beyond utilitarian limits is a possibility. In order that the tote bag 20 may be inflated to a determinable appropriate capacity without interfering with the storage and load carrying capacity of the bag, a brace 43 is disposed within the chamber 40 and is disposed transversely to and fastened at 43*a* and 43*b*, respectively, to the inner wall 33 and the inner surface 37 of the primary side wall 22.

By use of the brace or rib 43, the expansion of the bladder or chamber 40 is controlled within predetermined limits, thus insuring the full utility of the tote bag 20.

If the tote bag 20 is to have truly meaningful utility, it must be readily transportable by the user. Thus, suitable means for gripping and carrying the bag are essential. In focusing on the objective of keeping the configuration as simple and inexpensive as possible, however, the invention contemplates gripping the bag 20 by some adequate means which can be integrally formed in, or as part of, the primary side walls 22 and 24.

The foregoing objectives may be fully accomplished by providing cut outs 44 near the upper edge 46 of each of the primary side walls 22 and 24. The cutout, which can be formed quickly by stamping or by some equally facile method, is to be of such size as to permit the user to insert several fingers therethrough. The cut outs are axially aligned and coplanar to facilitate their purpose, with the result that the cut outs in both side walls together define a handle with which the bag 20 may be gripped, indeed in closed relation if desired, and carried from place to place by the user.

In order to reinforce the upper area of the tote bag about the cut outs 44, the primary side walls may be extended upwardly, and then folded over as at 48, thereby providing a double wall thickness.

As previously stated, the primary side walls 22 and 24 are typically mirror images of one another as a means of maintaining proportion. However, it is within the purview of the invention that the side wall that does not have the inner wall 33 attached to it may be disproportionate at the bottom, as may be seen in FIG. 2. By providing additional material, as shown generally at 50, the capacity of the tote bag 20 is increased with the carrying capacity proportionately expanded.

Finally, it will occur to the reader that the bag of the present invention has additional utility as a cushion upon which the user may repose to obtain relief for his or her tired body, or perhaps to soften the bench upon which the user is forced to sit to watch his or her favorite sporting event. Also, it will come as no surprise that the bag may serve as a floatation device. Upon inflation, the weight of the water displaced will normally exceed the weight of the bag, even when filled, and thus the entire bag will float if, for example, it is inadvertently dropped into water, or if user and bag somehow end up in the water together.

Having now provided a detailed description of a preferred embodiment, what is claimed is:

1. A multipurpose, selectively inflatable tote bag comprising, in combination:

a pair of primary side walls, said side walls being positioned in opposed face to face relation, each said side wall defined by at least one joinable edge; the joinable edges of opposed side walls being conjoined there along to thereby define a receptacle;

an inner wall, said inner wall being of lesser dimension than either of said primary side walls, said inner wall being sealingly connected to one of said side walls, said inner wall and said side wall to which said side wall is sealingly connected together defining a bladder; said bladder being air tight;

an inflation valve; said inflation valve being secured in one of said side walls and said inner wall defining said bladder, said inflation valve being selectively openable to provide access to said bladder for inflating and exhausting the same at the convenience of the user, and closeable to inhibit exhaustion of air introduced into said bladder;

and gripping means, said gripping means being integrally formed in said primary side walls for lifting, opening, closing and carrying said tote bag.

2. The novel tote bag of claim 1, wherein said inflation valve is affixed to said inner wall.

3. The novel tote bag of claim 1, wherein said side walls and said inner wall are constructed of a fusible material.

4. The novel tote bag of claim 1, wherein said gripping means comprises handles.

5. The novel tote bag of claim 4, wherein said handles are integrally formed on each said primary side wall.

6. The novel tote bag of claim 1, wherein each said side wall has a free terminal edge;

a cut out defined inwardly of said free terminal edge, said cut out being of such dimension as to receive one or more fingers of a user's hand for gripping and carrying said tote bag.

7. The novel tote bag of claim 1, wherein said bladder is orally inflatable through said inflation valve.

8. The novel tote bag of claim 1, wherein said bladder is inflatable to a volume such that the weight of water displaced by said tote bag exceeds the weight of the inflated bag.

9. A multipurpose, selectively inflatable tote bag comprising, in combination:

a pair of primary side walls, said side walls being positioned in opposed face to face relation, each said side wall defined by at least one joinable edge; the joinable edges of opposed side walls being conjoined there along to thereby define a receptacle;

an inner wall, said inner wall being of lesser dimension than said primary side walls, and sealingly connected to one of said side walls, said inner wall and said side wall to which said side wall is sealingly connected together defining a bladder; said bladder being inflatable, selectively configured to be air tight upon inflation;

a rib, said rib being disposed transversely to, and between said inner wall and said side wall to which said inner wall is attached, said rib being secured to said inner wall and said side wall to limit expansion of said bladder without impeding flow of air introduced therein;

an inflation valve; said inflation valve being secured in one of said side walls and said inner wall defining said bladder, said inflation valve being selectively openable to provide access to said bladder for inflating and exhausting the same at the convenience of the user, and closeable to inhibit exhaustion of air introduced into said bladder;

and gripping means, said gripping means being integrally formed with said primary said walls for lifting, opening, closing and carrying said tote bag.

10. The novel tote bag of claim 9, wherein said inflation valve is affixed to said inner wall.

11. The novel tote bag of claim 9, wherein said side walls and said inner wall are constructed of a fusible material.

12. The novel tote bag of claim 9, wherein said handles are integrally formed on each said primary side wall.

13. The novel tote bag of claim 9, wherein each said side wall has a free terminal edge;

a cut out defined inwardly of said free terminal edge, said cut out being of such dimension as to receive one or more fingers of a user's hand for gripping and carrying said tote bag.

14. The novel tote bag of claim 9, wherein said bladder is orally inflatable through said inflation valve.

* * * * *